US008393113B2

(12) United States Patent
Rex

(10) Patent No.: US 8,393,113 B2
(45) Date of Patent: Mar. 12, 2013

(54) SUCTION CUP SURFACE MOUNTED SHELF AND PLANTER ASSEMBLY

(75) Inventor: Christina Ann Rex, Johnson City, NY (US)

(73) Assignee: Christina Ann Rex, Johnson City, NY (US)

( * ) Notice: Subject to any disclaimer, the term of this patent is extended or adjusted under 35 U.S.C. 154(b) by 0 days.

(21) Appl. No.: 13/097,499

(22) Filed: Apr. 29, 2011

(65) Prior Publication Data

US 2012/0272571 A1 Nov. 1, 2012

(51) Int. Cl.
*A01G 9/02* (2006.01)

(52) U.S. Cl. ..... 47/66.6

(58) Field of Classification Search ..... 47/66.6, 47/68

See application file for complete search history.

(56) References Cited

U.S. PATENT DOCUMENTS

| | | | | | |
|---|---|---|---|---|---|
| 1,343,568 | A | * | 6/1920 | Leitch | 248/507 |
| 1,436,601 | A | | 11/1922 | Niemeyer | |
| 1,446,231 | A | | 2/1923 | West | |
| 1,558,977 | A | | 10/1925 | Gray | |
| 1,713,116 | A | | 5/1929 | Curtis | |
| 1,809,216 | A | | 6/1931 | Quandt | |
| 1,914,617 | A | | 6/1933 | Rogers | |
| 1,933,374 | A | * | 10/1933 | Haggard | 248/206.1 |
| 1,989,294 | A | | 1/1935 | Serpico | |
| 2,063,289 | A | | 7/1935 | Alugsas | |
| 2,029,246 | A | | 1/1936 | McCarroll | |
| D104,934 | S | * | 6/1937 | Whited | D6/540 |
| 4,052,816 | A | * | 10/1977 | Perez | 47/40 |
| 4,261,294 | A | * | 4/1981 | Bescherer | 119/57.8 |
| 4,376,521 | A | * | 3/1983 | Walters | 248/206.3 |
| 4,475,306 | A | | 10/1984 | Mehrens | |
| D291,610 | S | * | 8/1987 | Metzner | D30/124 |
| D361,238 | S | * | 8/1995 | Richards et al. | D6/574 |
| 5,547,088 | A | * | 8/1996 | Belokin et al. | 211/87.01 |
| D385,507 | S | | 10/1997 | Hulsebus | |
| D389,091 | S | | 1/1998 | Dickinson et al. | |
| D393,605 | S | | 4/1998 | Dallaire | |
| D403,268 | S | | 12/1998 | Dingman | |
| D416,728 | S | * | 11/1999 | Kelso et al. | D6/525 |
| D419,352 | S | | 1/2000 | Hampshire | |
| D419,808 | S | | 2/2000 | Hampshire | |
| D450,011 | S | | 11/2001 | Fan | |
| 6,615,540 | B1 | | 9/2003 | Muller | |
| D614,992 | S | | 5/2010 | DiPaolo et al. | |
| D621,193 | S | * | 8/2010 | Bauchet et al. | D6/574 |
| 7,841,298 | B2 | | 11/2010 | Margerum et al. | |
| 2007/0029327 | A1 | * | 2/2007 | Belokin et al. | 220/483 |
| 2009/0045155 | A1 | * | 2/2009 | Howard | 211/186 |

* cited by examiner

*Primary Examiner* — Frank T Palo

(57) ABSTRACT

Suction Cup Surface Mounted Shelf and Planter Assembly, when temporarily affixed to any appropriate surface, can be used to simulate an indoor greenhouse and/or used as an outdoor window box planter. The Assembly can also be used as a support and containment system for any appropriate item. The Suction Cup Surface Mounted Shelf can be used independently from the planter and serve as a general purpose shelf to hold appropriate items. The Planter can be utilized as a freestanding planter and/or serve as a general purpose container to hold appropriate items.

1 Claim, 1 Drawing Sheet

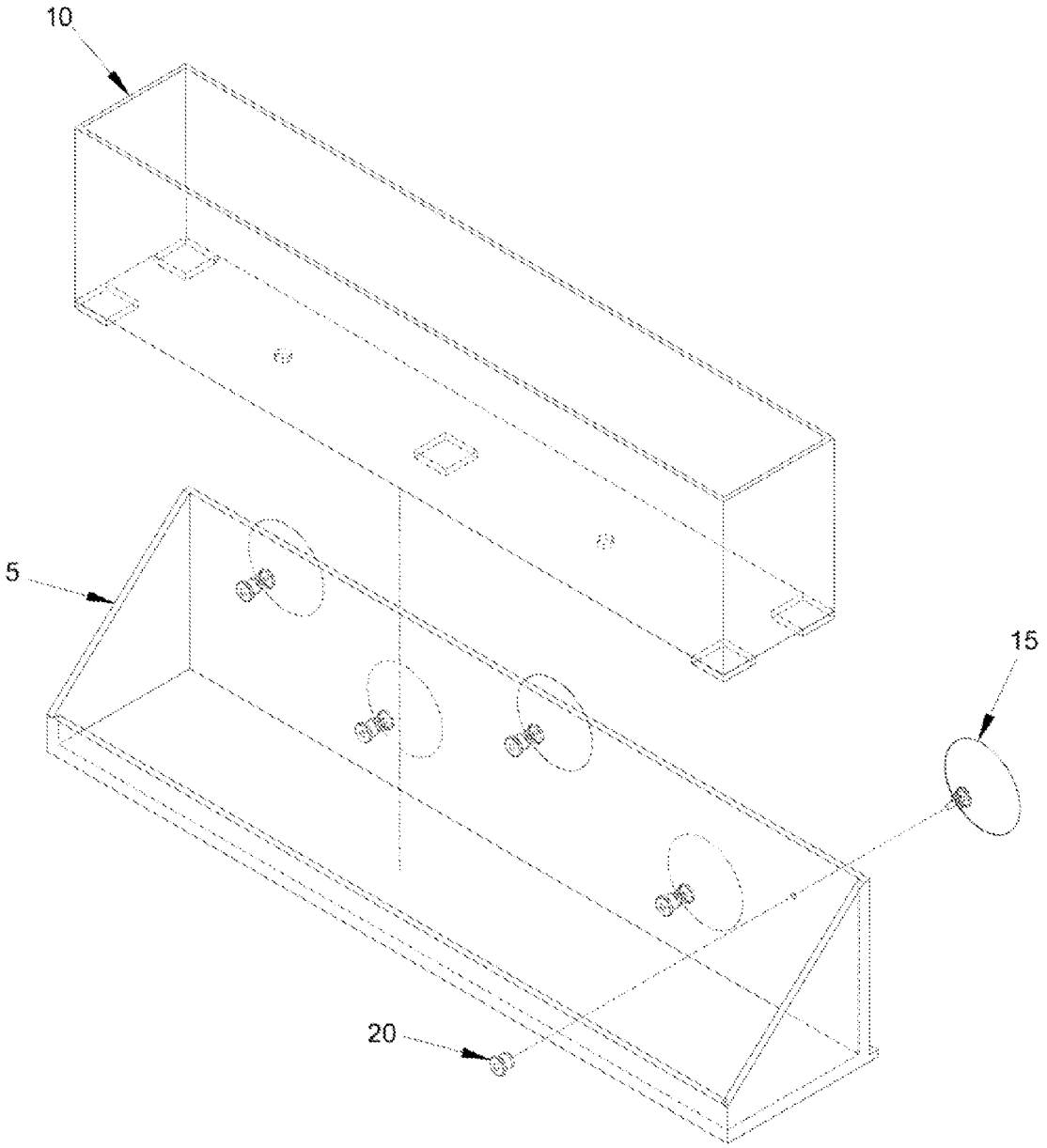
10
5
15
20

SUCTION CUP SURFACE MOUNTED SHELF AND PLANTER ASSEMBLY

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to a surface mounted shelf and planter assembly, specifically used with any appropriate surface, suction cup and suction cup assembly to allow for a temporary surface mounted shelf and planter inside or outside a dwelling.

2. Prior Art

Over the years many people have invented portable or temporarily affixed support devices for window sills to allow for placement of cut flowers in vases, plants/planters, starting plant seedlings, ripening fruits/vegetables and the like. For example, U.S. Pat. No. 1,436,601 (1922), U.S. Pat. No. 1,446,231 (1923), U.S. Pat. No. 1,558,977 (1924), and U.S. Pat. No. 1,713,116 (1929) provide portable support, however the entire device and items on the device may need to be moved, readjusted or removed if the window were to be moved into open position. Typically, the above devices were meant to be installed on the inside of a dwelling related accessibility issues. U.S. Pat. No. 1,809,216 (1927), U.S. Pat. No. 1,914,617 (1931), U.S. Pat. No. 1,989,294 (1933), U.S. Pat. No. 2,029,246 (1934), U.S. Pat. No. 2,063,289 (1935) and U.S. Pat. No. 4,475,306 (1984) provided temporary affixed support, however mandated that the support device be temporarily mounted with the use of fastening devices, therefore compromising the integrity of the window sill plate and/or jamb. Although most of the temporary mounted devices would remain in place when the window was opened, items that were placed on the devices may need to be moved, readjusted or removed to gain access to be able to open the window.

An extensive amount of prior art has been disclosed related to planters, planter boxes, soil containment systems for plant growth, flower boxes, flower pots, and the like for example U.S. Pat. D614,992 S (2010), U.S. Pat. No. 6,615,540 B1 (2003), U.S. D450,011 S (2001), Des. 403,268 (1998), Des. 393,605 (1998), Des. 389,091 (1998), Des. 385,507 (1995). Typically, pots and containers are any size and shape and are comprised of walls of equal height attached to a base surface. The container will characteristically have at least one vertically disposed hole in the base surface, and the pot or container will sit in a type of shallow tray to prevent liquid from running onto the surrounding supporting surface.

Suction cups are well known in the art and are widely used for affixing items to smooth, non-porous surfaces. Suction cups and suction cup assemblies have been used in a variety of different patents, including but not limited to, soap dishes, tooth brush holders, tooth paste holders, window mounted bird feeders, shower caddies, waste receptacles, and baskets for example U.S. Pat. Des. 419,352 (January 2000) and Des. 419,808 (February 2000).

BRIEF SUMMARY OF THE INVENTION

A surface mounted shelf and planter assembly, used in conjunction with the suction cup, suction cup assembly and any appropriate surface, inside or outside a dwelling or the like. Temporary grip with the use of the suction cup and suction cup assembly enables ease in attachment and removal of the suction cup surface mounted shelf and planter assembly, resulting in no damage to the surface to which it was attached.

BRIEF DESCRIPTION OF DRAWING

FIG. 1 is a perspective view of the apparatus as claimed.

DETAILED DESCRIPTION OF THE PREFERRED EMBODIMENT

Reference numeral (5) illustrates a surface mounted shelf (5) consisting of a front wall, a back wall and two side walls of varying heights and angles and a base platform which includes a back wall support section. The front wall of the surface mounted shelf (5) is represented as the shortest side to allow ease in placement of the planter (10) and to allow for liquid runoff collection if used with the planter (10) and support for items that could shift or travel off the shelf if the shelf is used in the absence of the planter (10). The right and left walls of the surface mounted shelf (5) are represented as angular sections to allow for maximum support and load bearing capability of the surface mounted shelf (5). The back wall of the surface mounted shelf (5) is the main support for the assembly and is used in conjunction with the suction cup assembly (15) (20) and any appropriate surface to which it is affixed. The back wall has a series of holes bored to attach the suction cup assembly (15) (20). The surface mounted shelf base platform (5) provides a base for the planter (10) or other items to be placed. The surface mounted shelf base platform (5) sits flush with the surface mounted shelf front wall (5) and extends to an adequate distance past the surface mounted shelf back wall (5) based on suction assembly (15) (20) depth, to allow for maximum support related to vertical and horizontal torque.

Reference numeral (10) illustrates a planter consisting of a front wall, a back wall, two side walls and a base platform. The planter (10) is designed to be placed within the surface mounted shelf container (5). Risers are placed on the bottom side of the planter base platform (10) to allow for a gap between the outside base platform of the planter (10) and the inside base platform of the surface mounted shelf (5). Vertically disposed holes are placed in the planter base platform (10) to allow for adequate liquid drainage.

Reference numeral (15) and reference numeral (20) illustrate proximate suction cup assembly placement.

After placement of each complete suction cup assembly to the back wall of the surface mounted shelf (5), the suction cup (15) (20) surface mounted shelf (5) is able to be affixed to any appropriate surface. The planter (10) is then able to be positioned inside the suction cup (15) (20) surface mounted shelf (5) to complete the assembly.

CONCLUSION, RAMIFICATIONS, AND SCOPE

Accordingly, as most plants need warmth, dampness and light to thrive which are requirements that sometimes can only be met in a greenhouse type of atmosphere. The suction cup surface mounted shelf and planter assembly can be used to transform any existing indoor window into a greenhouse garden. Because the suction cup surface mounted shelf and planter assembly is temporarily attached to the window and elevated off of the sill via the use of suction cups; there is no loss in window function (opening/closing) and/or no damage to the window, window sill, window rail and/or window.

The suction cup surface mounted shelf and planter assembly can also be used as an outdoor window planter box. Because the suction cup surface mounted shelf does not require permanent attachment, the suction cup surface mounted shelf and planter assembly can be used without any damage to outdoor siding, windows, window aprons, window sills, window jambs, window casing and/or window sash. The suction cup surface mounted shelf is specifically designed to catch liquid that drains from the planter, reducing water damage issues that commonly occur with other sill mounted planter systems. The planter is designed to be a free-standing, with the ability to rotate to increase plant photosynthesis and decrease stem phototropism (bending toward light).

The suction cup surface mounted shelf and planter assembly can be used as a support and containment system for any appropriate item and can be attached to any appropriate surface. The suction cup surface mounted shelf can be used independently from the planter to ripen fruit, dry herbs, or serve as a general purpose shelf to hold appropriate items. The planter can be utilized as a freestanding planter and/or serve as a general purpose container to hold appropriate items.

I claim:

1. A load bearing support shelf and planter system comprising:

a sealed, watertight shelf having angular side walls as load bearing support;

a plurality of suction cup attachment devices and means for joining said devices to said shelf; and a free-standing planter for placement into said watertight shelf;

whereby, the support shelf and planter system is removably adhered via said attachment devices to a smooth surface.

* * * * *